US006170418B1

(12) United States Patent
Jaeger

(10) Patent No.: US 6,170,418 B1
(45) Date of Patent: Jan. 9, 2001

(54) METHOD AND ARRANGEMENT FOR TRANSMITTING YARN-SPECIFIC DATA DURING REWINDING PROCESSES FOR PRODUCING TWO-THREAD LOCK STITCH SEAMS WHICH ARE TO BE DOCUMENTED

(75) Inventor: Guido Jaeger, Bensheim (DE)

(73) Assignee: KSL Keilmann Sondermaschinenbau GmbH, Lorsch (DE)

( * ) Notice: Under 35 U.S.C. 154(b), the term of this patent shall be extended for 0 days.

(21) Appl. No.: 09/308,075

(22) PCT Filed: Nov. 12, 1997

(86) PCT No.: PCT/EP97/06320

§ 371 Date: Jun. 29, 1999

§ 102(e) Date: Jun. 29, 1999

(87) PCT Pub. No.: WO98/21389

PCT Pub. Date: May 22, 1998

(30) Foreign Application Priority Data

Nov. 12, 1996 (DE) ..... 196 46 707

(51) Int. Cl.[7] ..... D05B 59/00

(52) U.S. Cl. ..... 112/475.01; 112/278; 112/279; 242/370

(58) Field of Search ..... 112/475.01, 470.01, 112/270, 278, 279; 242/370; 209/583

(56) References Cited

U.S. PATENT DOCUMENTS

| | | | | |
|---|---|---|---|---|
| 4,166,423 | | 9/1979 | Brienza et al. . | |
| 4,481,507 | | 11/1984 | Takiguchi et al. . | |
| 4,854,453 | * | 8/1989 | Ueda et al. | 209/583 |
| 5,003,762 | | 4/1991 | Scaglia . | |
| 5,211,121 | * | 5/1993 | Sakakibara | 112/278 |
| 5,235,516 | | 8/1993 | Ellis, Jr. et al. . | |
| 5,353,726 | * | 10/1994 | Bruder et al. | 112/278 X |
| 6,012,402 | * | 1/2000 | Sekine | 112/102.5 |

FOREIGN PATENT DOCUMENTS

| | | | |
|---|---|---|---|
| 3923507A | 1/1991 | (DE) | G06K 1/12 |
| 9215334 U | 3/1993 | (DE) | B65H 75/12 |
| 4216286A | 12/1993 | (DE) | B65H 71/00 |
| 342527A | 11/1989 | (EP) | B65H 67/06 |

* cited by examiner

*Primary Examiner*—Peter Nerbun
(74) *Attorney, Agent, or Firm*—McCormick, Paulding & Huber LLP

(57) ABSTRACT

Method for transmitting thread-specific data in re-reeling operations for the manufacture of two-thread lock stitch seams which have to be documented comprising the following steps: the bobbin taking over the thread, in particular the under-thread bobbin (10) is provided with a definite bobbin identification, in a reeling station (28), in which thread material for the under-thread is reeled from a thread stock (30) onto the under-thread bobbin (10), the bobbin identification is detected and is stored in a data storage medium (24) together with a first data record characterizing the thread material and the reeling operation, after inserting the under-thread bobbin (10) into a sewing machine (18) the bobbin identification is detected, from the bobbin identification the first data record stored therewith is determined and is assigned to a second data record concerning the sewing operation and/or the sewn product, whereupon the data set so formed is stored.

5 Claims, 3 Drawing Sheets

METHOD AND ARRANGEMENT FOR TRANSMITTING YARN-SPECIFIC DATA DURING REWINDING PROCESSES FOR PRODUCING TWO-THREAD LOCK STITCH SEAMS WHICH ARE TO BE DOCUMENTED

BACKGROUND OF THE INVENTION

The invention relates to a method for transmitting thread-specific data in rereeling operations for the manufacture of two-thread lock stitch seams which have to be documented as well as an arrangement for carrying It out.

With Increasing measures for quality assurance in all areas of modern technology the knowledge of production data is indispensable when manufacturing a product. In the concluding documentation of the manufacturing process these data are combined together with the data of the components involved in the manufacturing process in a data record, which is assigned to the respective product and can be interrogated by means of a code number or the like at any time.

In connection with the manufacture of release seams on sewings also the underthread has to be documented beside other components in the case of two-thread lock stitch seams. Since the under-thread bobbin is on the one hand indispensable for the manufacturing process of the two-thread lock stitch seam, but on the other hand its capacity is highly restricted, it only serves as an Intermediate carrier for the under-thread.

As a result there is the problem that the information concerning the thread material used for the under-thread, such as article number or batch number cannot be transferred onto the under-thread bobbin during the reeling operation. After the thread had been reeled onto the under-thread bobbin and the bobbin had been taken out of the conventional reeling station, there is consequently no possibility left of identifying the reeled thread and of storing detailed information about it. Thus, there is also no possibility of specifying the under-thread designed as release thread in the documentation.

SUMMARY OF THE INVENTION

The problem to be solved by the invention is to make a complete documentation of the data concerning the under-thread in two-thread lock stitch seams in connection with other data on the manufacturing process of a sewed product possible, while avoiding the abovementioned disadvantages.

This problem is solved by the invention in such a way that the bobbin holding the thread, in particular the under-thread bobbin is provided with a definite bobbin identification, that in a reeling station, in which thread material for the under-thread is reeled from a thread stock onto the under-thread bobbin, the bobbin identification Is detected, and is stored together with a first data record characterizing the thread material and the reeling operation in a data storage medium, that the bobbin identification is detected after inserting the under-thread bobbin into a sewing machine, that from the bobbin identification the first data record stored therewith is determined and is assigned to a second data record concerning the sewing operation and/or the sewing and that the data set formed in this way is stored.

Due to the definite identification of the under-thread bobbins it is possible to assign a certain length of thread material of the clearly identified thread stock to a certain seam of a product and thus to obtain the thread data of the under-thread in a data record characterizing the manufacture of a product. The bobbin identification is of no importance for the final data record. It only serves to establish the connection between the first data record and the second data record.

In order to make it possible that the under-thread bobbins can be used again and again, the assignment of the first data record to the bobbin identification is according to the Invention, deleted in the reeling station, after the under-thread had been used up and a possibly remaining thread had been removed from the respective under-thread bobbin, before a new thread is reeled onto the under-thread bobbin.

The invention further relates to an arrangement for transmitting thread-specific data in re-reeling operations for the manufacture of two-thread lock stitch seams, which have to be documented, in two-thread lock stitch machines having at least one sewing machine and one reeling station in which thread for the under-thread is reeled from a thread stock onto the under-thread bobbin which has to be inserted into the sewing machine. According to the invention, this arrangement is characterized in that the under-thread bobbins are provided each with a definite bobbin identification, that both the reeling station and the sewing machine each have a sensor for detecting the bobbin identification of each inserted under-thread bobbin, respectively, and that the sensors are linked to a data processing unit. which assigns the bobbin identification detected by the sensor of the reeling station to a first data record characterizing the under-thread and the reeling operation, and which stores the bobbin identification together with the first data record in a data storage medium and which determines the corresponding first data record by means of the bobbin identification detected by the sensor of the sewing machine, assigns it to a second data record characterizing the sewing operation and/or the sewing and stores it together therewith. In a preferred embodiment of the invention the bobbin identification is applied to at least one flange of the under-thread bobbin in the form of a bar code, the sensors in the reeling station and in the sewing machine being bar code readers.

The method according to the invention is not restricted to the rereeling of a thread onto the under-thread bobbin of a two-thread lock stitch machine, but can be used for all rereeling operations.

The following description explains the invention with an embodiment in connection with the endosed drawing. It is illustrated in

DETAILED DESCRIPTION OF THE PREFERRED EMBODIMENT

Figure 1:
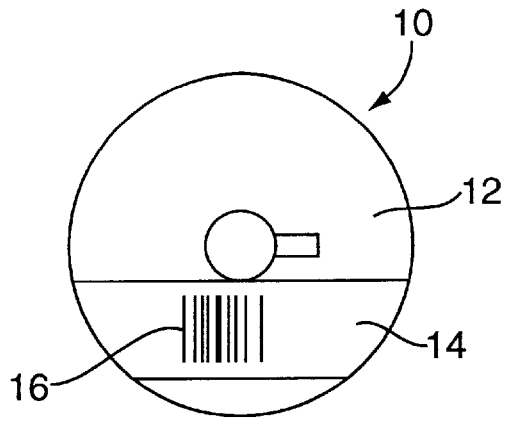
FIG. 1 a side view of an under-thread bobbin.

FIG. 1 illustrates an under-thread bobbin 10 used for insertion into a two-thread lock stitch sewing machine, said under-thread bobbin 10 having an area 14 on the surface of one of its flanges 12, on which an identification number 16 in the form of a bar code clearly identifying the respective under-thread bobbin 10 is printed. Of course, also a different form of code being legible by machines can be chosen.

Figure 2:
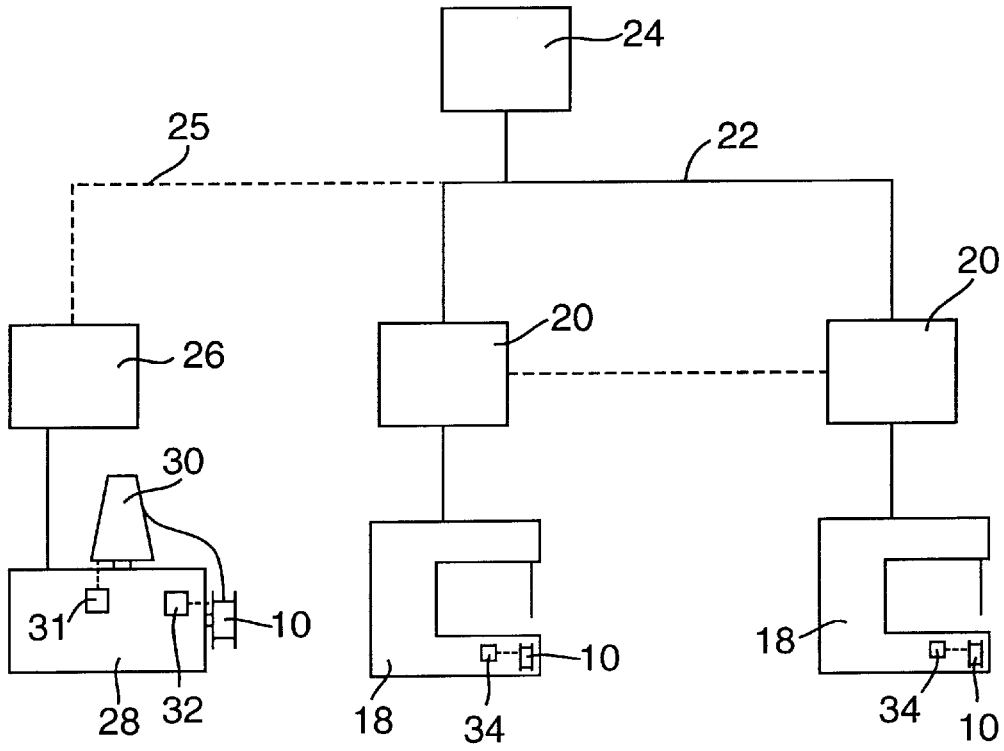
FIG. 2 in a schematic way an arrangement of several two-thread lock stitch sewing machines, having an interconnection of data with a reeling station and a control unit, and FIGS. 3*a* and 3*b* a flow chart for explaining the method according to the invention.

FIG. 2 shows a plurality of schematically illustrated two-thread lock stitch sewing machines 18 which are controlled each by a PC 20. Via a data and control line 22 the PCs of the individual sewing stations are connected with a central data processing unit 24. Further, the PCs of the individual sewing stations and/or the data processing unit 24 are connected with a PC 26 via a line 25, said PC controlling a reeling station 28. The line 25 can be every means that allows an information flow between the PC 26 and the data processing unit 24.

The reeling station 28 serves to reel a length of a thread material determined for forming the under-thread from a thread cone 30 onto an under-thread bobbin 10. The reeling station 28 has a first schematically illustrated sensor or bar code reader 31 for reading a bar code provided at the thread cone 30 and a second schematically illustrated sensor or bar code reader 32 which is able to read the bar code 16 on the flange 12 of the under-thread bobbin 10 inserted into the reeling station 28. The so determined identification number of the under-thread bobbin 10 just inserted into the reeling station 28 is assigned to a first data record in the PC 26 or in the data processing unit 24, said first data record characterizing the thread cone 30 (e.g. article number and batch number) and was entered into the PC 26 or was automatically detected by means of the sensor 31 in the reeling station. Further, the first data record comprises data on the reeling operation such as date of the reeling operation and length of the thread reeled up. The first data record is stored in the data processing unit 24 together with the identification number of the under-thread bobbin 10. Thus, the under-thread stock intermediately stored on a certain under-thread bobbin is clearly identified.

The two-thread lock stitch sewing machines 18 also have a sensor or bar code reader 34 which can read the identification number 16 on the bobbin flange 12 of the respective inserted under-thread bobbin 10. The identification number of the under-thread bobbin 10 so determined is transmitted to the data processing unit 24 together with a second data record containing data on the sewing operation and/or the sewing. By means of the transmitted bobbin identification 16 the data processing unit 24 can combine the already stored first data record with the second data record transmitted from the sewing machine, so that the combined data record now also contains the data characterizing the under-thread. Thus, the function of the bobbin identification is fulfilled. It is deleted from the data record The under-thread bobbin can be re-used again.

It is clear that it has to be guaranteed that each under-thread bobbin identification number is unique. The existence of bar code doublets has to be ruled out conclusively. By making amendments on the under-thread bobbin and on the creed mechanism for the under-thread bobbins at the reeling station it can be ensured that the under-thread bobbins according to the invention cannot be reeled on a conventional reeling apparatus. By means of additional color markings and information signs at the corresponding places of use the special function of the under-thread bobbins according to the invention can be pointed out to the service staff.

Figure 3A:
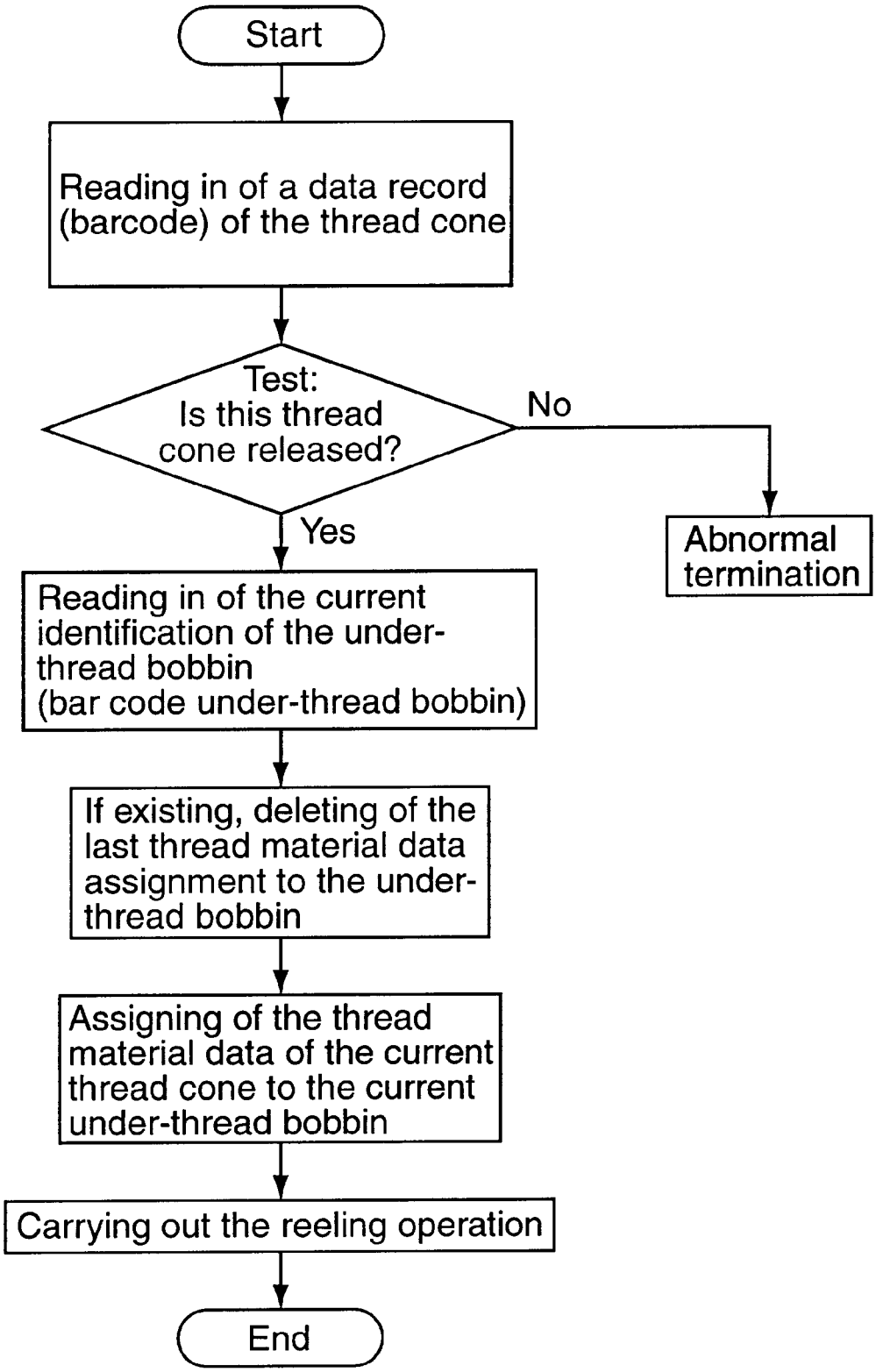
Figure 3B:
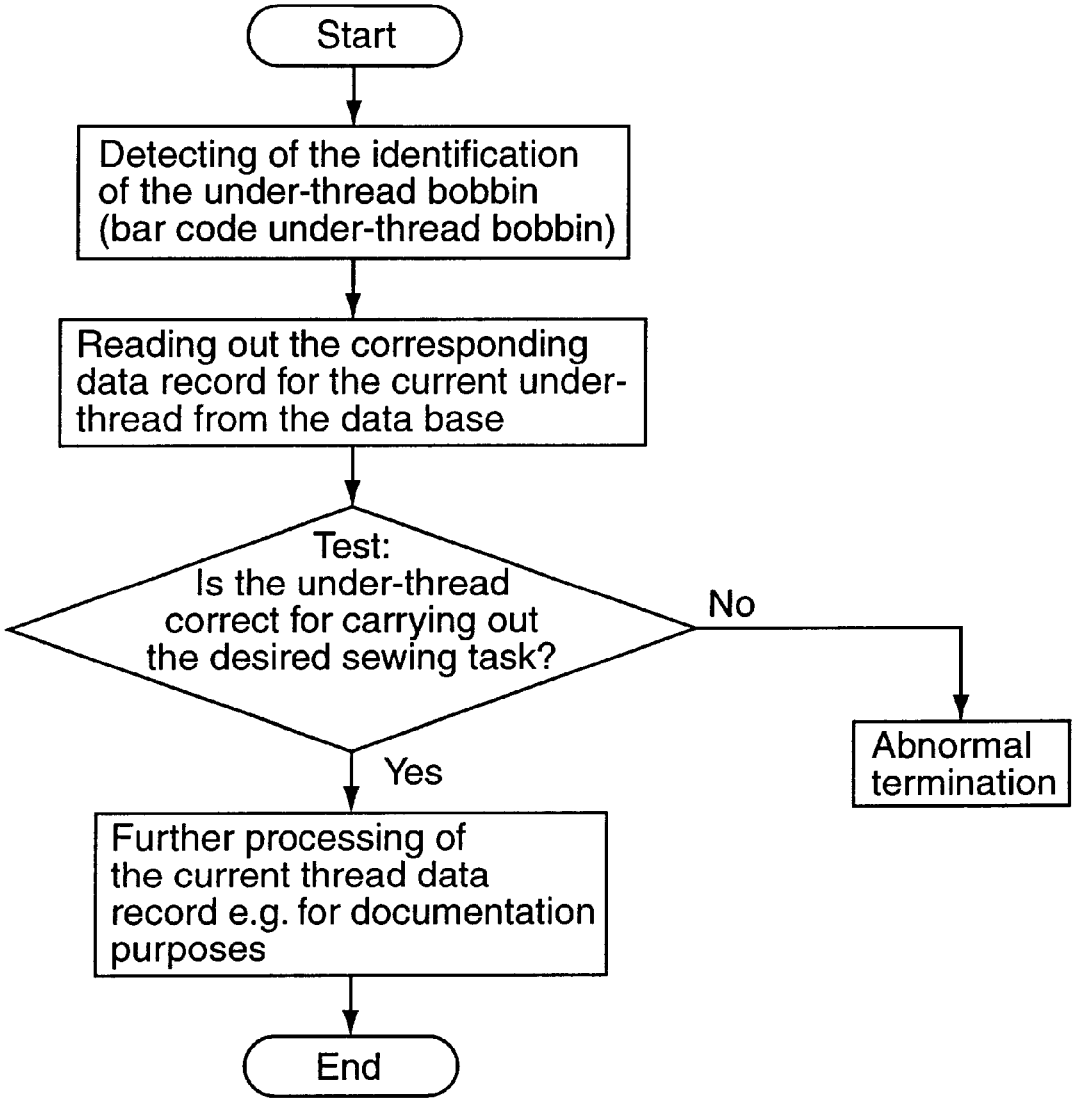

FIGS. 3*a* and 3*b* show the procedure steps when the assignment between the first data record and the identification of the under-thread bobbin at the reeling station 28 is established, or when the assignment is read out at the respective sewing machine 18. In both procedures a testing step is incorporated, respectively, after which the procedure can be stopped. At the reeling station 28 it is tested whether the thread cone 30 placed upon was released for use. The thread material is being checked for the quality demanded before the re-reeling operation. The test date are assigned to the first data record containing the thread data, said first data record being stored in the PC 26 and/or in the data processing unit 24. An identification of the thread cone 30 is detected by means of the bar code reader 31 and the corresponding data record is determined by the test data. In case the test criterions are met, the rereeling operation takes place as described in FIG. 3*a*. If such a positive test criterion is missing the rereeling operation will not be started.

In FIG. 3*b* it is checked whether the thread on the inserted under-thread bobbin is suitable for the respective sewing function. In this case, too, the sewing operation is not started if the result of this test is negative.

What is claimed is:

1. A method for transmitting thread-specific data in re-reeling operations for the manufacture of two-thread lock stitch seams which have to be documented, said method comprising: providing a bobbin taking over a thread, in particular an under-thread bobbin (10), with a definite bobbin identification (16), in a reeling station (28) reeling thread material for the under-thread from a thread stock (30) onto the under-thread bobbin (10) and detecting the bobbin identification (16), storing the detected bobbin identification in a data storage medium together with a first data record characterizing the thread material and the reeling operation, after inserting the under-thread bobbin (10) into a sewing machine (18) again detecting the bobbin identification (16), from the again detected bobbin identification (16) determining the first data record stored therewith, assigning the determined first data record to a second data record concerning a sewing operation and/or a sewn product to form a data set and then storing the data set.

2. A method according to claim 1, wherein the assignment of the first data record to the bobbin identification is deleted after the under-thread had been used up and a possible remaining thread had been removed from the under-thread bobbin (10), before a new thread is reeled onto the under-thread bobbin (10).

3. Apparatus for transmitting thread-specific data in re-reeling operations for the manufacture of two-thread lock stitch seams, which have to be documented, in two-thread lock stitch machines, said apparatus comprising: at least one sewing machine (18), and a reeling station (28) in which thread for an under-thread is reeled in a reeling operation from a thread stock (30) onto under-thread bobbins (10) which have to be inserted into the sewing machine (18), wherein the under-thread bobbins (10) are each provided with a definite bobbin identification (16), both the reeling station (28) and the sewing machine (18) each have a sensor (32) or (34) for detecting the bobbin identification (16) of each inserted under-thread bobbin (10) and the sensors (32, 34) are linked to a data processing unit (24) which assigns the bobbin identification (16) detected by the sensor (32) of the reeling station (28) to a first data record characterizing the under-thread and/or the reeling operation as well as stores the bobbin identification (16) together with the first data record in a data storage medium, and which determines the corresponding first data record from the bobbin identification (16) detected by the sensor (34) of the sewing machine (18), assigns said first data record to a second data record characterizing a sewing operation and/or a sewn product and stores said first data record together with said second data record.

4. Apparatus according to claim 3, wherein the bobbin identification (16) is printed on at least one flange (12) of the under-thread bobbin (10) in the form of a bar code, and the sensors (32, 34) of the reeling station (28) and the sewing machine (18) are bar code readers.

5. An under-thread bobbin for a two-thread lock stitch sewing machine, characterized in that it has a bobbin identification enabling the under-thread bobbin to be uniquely distinguished from other under-thread bobbins usable with said sewing machine.

* * * * *